United States Patent [19]

Kamohara et al.

[11] Patent Number: 4,947,818

[45] Date of Patent: Aug. 14, 1990

[54] INTERNAL COMBUSTION ENGINE WITH DEVICE FOR WARNING OF MALFUNCTION IN AN AIR-FUEL RATIO CONTROL SYSTEM

[75] Inventors: Tatsuyoshi Kamohara; Tadashi Sugino; Toshio Suematsu; Satomu Nishimura, all of Toyota, Japan

[73] Assignee: Toyota Jidosha Kabushiki Kaisha, Japan

[21] Appl. No.: 330,319

[22] Filed: Mar. 28, 1989

[30] Foreign Application Priority Data

Apr. 28, 1988 [JP] Japan ..... 63-108089
Jun. 16, 1988 [JP] Japan ..... 63-149094

[51] Int. Cl.[5] ..... F02D 41/22; F02D 41/14

[52] U.S. Cl. ..... 123/479; 123/198 D; 123/489

[58] Field of Search ..... 123/440, 479, 489, 481, 123/198 D, 198 DB; 60/274, 276, 285; 364/431.05

[56] References Cited

U.S. PATENT DOCUMENTS 4,182,300 1/1980 Ono et al. ..... 123/198 D
4,483,300 11/1984 Hosaka et al. ..... 123/489
4,638,658 1/1987 Otobe ..... 123/440 X
4,739,614 4/1988 Katsuno et al. ..... 60/274

FOREIGN PATENT DOCUMENTS 62-220829 9/1987 Japan .
62-247148 10/1987 Japan .
62-298643 12/1987 Japan .

OTHER PUBLICATIONS

Collection of Toyota Technology V. 1667, Jan. 29, 87.

*Primary Examiner*—Tony M. Argenbright
*Attorney, Agent, or Firm*—Oliff & Berridge

[57] ABSTRACT

A warning system for an air-fuel ratio control system for a electronic controlled internal combustion engine, where a basic fuel injection amount is corrected by a feedback correction factor determined by a signal from an air-fuel ratio sensor arranged in an exhaust pipe. An amplitude of the feedback correction factor caused by an acceleration of the engine, where the exhaust from cylinders is not completely mixed, is detected, and a warning can be given when the amplitude of the feedback correction factor is larger than a predetermined value. A malfunction in the air-fuel ratio system occurring in one cylinder can be detected. In a double $O_2$ sensor system, where a sub-feedback loop is provided for correcting the feedback correction factor in accordance with a signal from the second $O_2$ sensor, the sub-feedback is stopped when the amplitude of the feedback correction factor is larger than a predetermined value, and a quick and precise detection of a malfunction is obtained by stopping the sub-feedback operation.

21 Claims, 17 Drawing Sheets

| Fig.3B | Fig.3A |
|---|---|

ROUTINE FOR DETECTION OF MALFUNCTION AIR-FUEL RATIO CONTROL
110
IS O2 SENSOR ACTIVATED
NO
YES
112
FB = 1 ?
NO
YES
114
C1←C1 + 1
116
C1 ≧ α ?
YES
NO
118
CALCULATE AND UPDATE TAmax AND TAmin
120
CALCULATE AND UPDATE FAFmax AND FAFmin
122
ΔTA = TAmax−TAmin
ΔFAF = FAFmax−FAFmin
123
ΔTA ≧ β1 ?
NO
YES
124
ΔTA ≧ β2 ?
NO
YES

ROUTINE FOR DETECTION OF A MALFUNCTION IN AIR-FUEL RATIO CONTROL

200
FB=1 ?
YES
NO
202
HAS 08 SECOND LAPSED ?
YES
NO
212
READ TA
214
ΔTA ← TA − TAφ
216
TAφ ← TA
218
ΔTA > β ?
YES
NO
204
FAF ≦ FAFmin ?
YES
NO
206
FAFmin ← FAF
208
FAF ≧ FAFmax ?
YES
NO
210
FAFmax ← FAF

SIGNAL OF DOWNSTREAM A/F SENSOR (37)

CHANGE IN FAF BY UPSTREAM A/F SENSOR (36) IN PRIOR ART

CHANGE IN FAF BY UPSTREAM A/F SENSOR (36) IN PRESENT INVENTION

INTERNAL COMBUSTION ENGINE WITH DEVICE FOR WARNING OF MALFUNCTION IN AN AIR-FUEL RATIO CONTROL SYSTEM

BACKGROUND OF THE INVENTION

1. Field of the Invention

The present invention relates to an apparatus for detecting a malfunction in an air-fuel ratio control operation for an internal combustion engine.

2. Description of Related Arts

In a known system for an internal combustion engine for controlling an air-fuel ratio in accordance with a detected air-fuel ratio by an air-fuel ratio sensor, an appropriate operation of the air-fuel ratio sometimes cannot be obtained due to a change in a characteristic after use or a tolerance, or to a malfunction. Therefore, it was proposed, in "Toyota Gijyutsu Kokai Syu (Collection of Published Technology of TOYOTA), volume number 1667, published on Jan. 29, 1988, to use a system wherein a product of a value of an air-fuel ratio correction factor, calculated as a value corresponding to an air fuel ratio in accordance with detected values of air-fuel ratio sensor, and a value of a learning correction factor, is calculated, and it is determined that a malfunction of the air-fuel ratio control has occurred when the value of the product of the air-fuel ratio correction factor and the air-fuel ratio learning correction factor is high.

This prior art suffers from a drawback in that a malfunction of the air-fuel ratio control cannot be detected when a plurality of causes of malfunctions occur simultaneously. Namely, the above system allows a detection of a malfunction caused when a single factor, such as a change in a characteristic of an air flow meter, occurs. But when, in addition to this malfunction related to the air flow meter, another malfunction, such as a change in the flow characteristic of a fuel injector after prolonged use or a changed tolerance of parts is added, the effects of these combined malfunctions sometimes negate each other, so that a malfunction of the air-fuel ratio control cannot be detected regardless of the fact that the air-fuel ratio control is not correct.

Furthermore, if a malfunction of an injector of one of the cylinders occurs, the exhaust gas from this cylinder is usually properly mixed with the exhaust gas from the remaining cylinders before it reaches the air-fuel ratio sensor. This means that the exhaust gas from the faulty cylinder can have only a very small effect on the air-fuel ratio correction factor to be calculated from the air-fuel ratio signal output by the air-fuel ratio sensor, since the exhaust gas from the faulty cylinder is "diluted" by the exhaust gas from the other unaffected cylinders, and thus a detection of a malfunction of the air-fuel control cannot be property effected.

This problem of a difficulty in detecting a malfunction grows larger when the air-fuel ratio control system has two air-fuel ratio sensors; one arranged upstream of a catalytic converter and the other arranged downstream of the catalytic converter. This double air-fuel ratio sensor system has a sub-feedback system for controlling the feedback correction factor in accordance with a signal from the second sensor, so that the amplitude of the feedback correction factor is decreased. Therefore, an impermissible amplitude of the feedback correction factor generated by a malfunction is apt to be suppressed by the operating of the sub-feedback system, and thus a quick and precise detection of a malfunction in one cylinder of the engine becomes difficult.

SUMMARY OF THE INVENTION

An object of the present invention is to provide an air-fuel ratio control system with a warning system capable of overcoming the above mentioned difficulty of the prior art.

Another object of the present invention is to provide a system capable of increasing an ability to detect a malfunction in the air-fuel ratio control system.

A further object of the present invention is to provide a system capable of quickly detecting a malfunction in a double air-fuel ratio sensor type air-fuel ratio control system.

Therefore, according to the present invention, an internal combustion engine is provided which comprises:

an engine body having a plurality of cylinders;

an intake system having a throttle valve for controlling an amount of air introduced into respective cylinders in the engine body;

an exhaust system having upstream portions separately connected to the respective cylinders of the engine body for a removal of resultant exhaust gas therefrom, and a common downstream portion;

means for supplying an amount of fuel into the intake system for providing a combustible mixture;

a first determining means, responding to basic operating conditions of the engine including an engine speed and load, for determining a target value of the air-fuel ratio matching the operating conditions;

a calculating means for calculating an amount of fuel to be supplied to the engine by the fuel supply means to obtain the target air-fuel ratio;

an air-fuel ratio sensor means arranged in the exhaust system at a common downstream portion for detecting an air-fuel ratio of the combustible mixture;

a correction means, responding to a difference between the target air-fuel ratio determined by the first determining means and the air-fuel ratio detected by the sensor means, for obtaining a correction value indicating a correction to be applied to the amount of fuel calculated by the second calculating means, said correction value being utilized for correcting the amount of fuel to be supplied by the fuel supply means;

second determining means for determining a predetermined sampling period;

detecting means for detecting, for each sampling period, a condition of the engine in which the exhaust gas from the cylinders can reach the first sensor means without being fully mixed, and;

a third determining means, responding to a change in the correction value during that period caused by the engine when in the non-mixing condition, for determining that a malfunction in the engine related to the air-fuel ratio control has occurred.

According to another aspect of the present invention, an internal combustion engine is provided which comprises:

an engine body having a plurality of cylinders;

an intake system having a throttle valve for controlling the amount of air introduced into respective cylinders in the engine body;

an exhaust system having upstream portions separately connected to the respective cylinders of the engine body for removal of resultant exhaust gas therefrom, and a common downstream portion;

means for supplying an amount of fuel into the intake system for providing a combustible mixture;

a catalytic converter arranged in the exhaust system;

a first determining means, responding to basic operating conditions of the engine including an engine speed and load, for determining a target value of the air-fuel ratio matching the operating conditions;

a calculating means for calculating an amount of fuel to be supplied to the engine by the fuel supply means to obtain the target air-fuel ratio;

a first air-fuel ratio sensor means arranged in the common downstream portion of the exhaust system located upstream of the catalytic converter for detecting an air-fuel ratio of the combustible mixture;

a first correcting means, responding to a difference between the target air-fuel ratio determined by the first determining means and the air-fuel ratio detected by the first sensor means, for determining a correction value indicating a correction to be applied to the amount of fuel calculated by said calculating means, the corrected amount of fuel being supplied by the fuel supply means;

second air-fuel ratio sensor means arranged in the exhaust system at a position downstream of the catalytic converter;

a second correction means, responding to an air-fuel ratio sensed by the second air-fuel ratio sensor means, for correcting the correction value by the first correcting means;

second determining means for determining a predetermined sampling period;

detecting means for detecting, for each sampling period, a condition of the engine in which the exhaust gas from the cylinders can reach the first sensor means without being fully mixed, and;

a third determining means, responding to a condition of a change in the correction value caused by the engine when in the non-mixing condition, for determining that a malfunction in the engine related to the air-fuel ratio control has occurred, and;

means for stopping the correction operation by the second correction means when a malfunction signal is output by the determining means.

Figure 1:
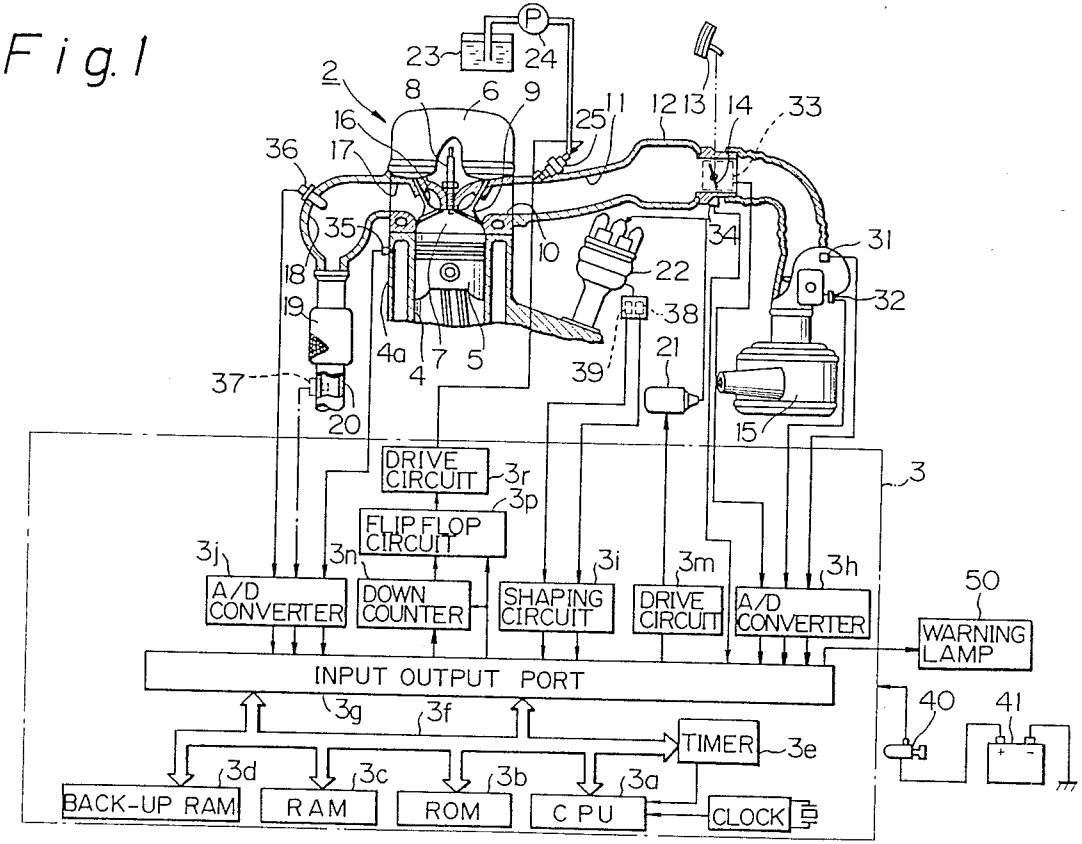
FIG. 1 is a schematic cross-sectional view of an internal combustion engine, according to the present invention, with an electronic control system.

The engine 2 is provided with a cylinder block 4, piston 5, and cylinder head 6, and a combustion chamber 7 is formed between the cylinder block 4, piston 5, cylinder head 6, an intake valve 9 and an exhaust valve 16. A spark plug 8 is mounted to the cylinder head 6 to provide a spark in the combustion chamber 7. The engine 2 is provided with an intake system having an intake port 10 opened to the combustion chamber 7 via the intake valve 9, an intake pipe 11, a surge tank 12 for absorbing pulsations in a pressure of the intake air, a throttle valve 14 connected to an accelerator pedal 13 for controlling an amount of intake air, and an air cleaner 15. The engine 2 is also provided with an exhaust system provided with an exhaust port 17 opened to the combustion chamber 7 via the exhaust valve 16, an exhaust manifold 18 connected to the exhaust port 17, a catalytic converter 19 provided therein with a three way catalytic substance, and an exhaust pipe 20.

Figure 2:
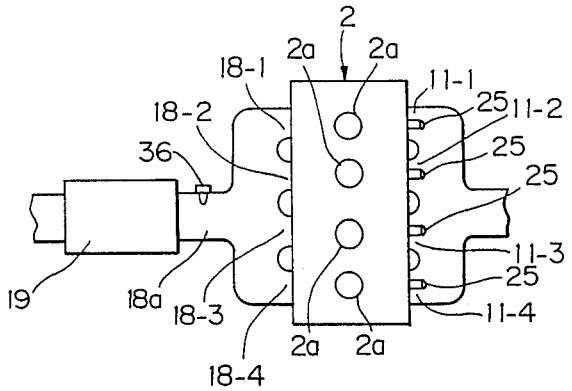
FIG. 2 is a schematic upper view of the engine according to the present invention.

In this embodiment, the engine has four cylinders 2*a* (FIG. 2), connected to respective branch portions 11-1 to 11-4 of the intake pipe 11, and branch portions 18-1 to 18-4 of the exhaust pipe 18. The branch portions are gathered to a pipe portion 18*a* at which the oxygen sensor 36 is provided.

In FIG. 1, the engine is further provided with an ignition system having an ignitor provided at an ignition coil 21 for generating a high voltage electric current of, and a distributor 22 for selectively supplying the electric current from the ignition coil 21 to the spark plug 8 of the cylinders.

The engine 2 is provided with a fuel supply system having a fuel tank 23 for storing fuel, a fuel pump 24 for obtaining a constant supply of fuel, and electromagnetic type fuel injectors 25 arranged in the intake system at positions near the respective intake ports 10.

The engine is further provided with various detectors for detecting the engine operating conditions. An air flow meter 31 is arranged in the intake pipe 11 at a position upstream of the throttle valve 14; a temperature sensor 32 is arranged in the air flow meter 31 for detecting the temperature of the air introduced into the engine; a throttle position sensor 33 is operatively connected to the throttle valve 14 for detecting the degree of opening of the throttle valve 14; an idle switch 34 is connected to the throttle valve 14 to detect an idling position of the throttle valve 14; a temperature sensor 35 is arranged in a water jacket of the cylinder block of the engine for detecting the temperature of the engine cooling water; an oxygen sensor 36, called an $O_2$ sensor in this embodiment, is arranged in the exhaust pipe 18 for detecting the air-fuel ratio of the combustible mixture introduced into the combustion chamber 7; a first crank angle sensor 38 is arranged in the distributor 22 and issues a pulse signal at every 720 degrees of rotation of the crankshaft corresponding to one complete cycle of the engine, which pulse signal serves as reference signal for identifying a particular cylinder when executing a fuel injection operation; and a second crank angle sensor 39 arranged in the distributor 22 and issues a pulse signal at every 30 degrees of rotation of the crankshaft, which pulse signal is used for detecting an engine speed.

These sensors and switches are connected to the electronic control device 3 and introduce thereto signals indicating various parameters affecting the operation of the engine 2. The electronic control device 3 is provided with a CPU 3*a*, a ROM 3*b*, a RAM 3*c*, a back-up RAM 3*d*, a timer 3*e*, and a bus 3*f* interconnecting these parts. The CPU 3*a* receives signals from the air flow meter 31, intake air temperature sensor 32, and throttle position sensor 33 via an analog to digital convertor 3*h* and input-output port 3*g*, signals from the cylinder identification sensor 38 and engine speed sensor 39 via a wave forming circuit 3*i* and input-output port 3*g*, and signals from the engine cooling water temperature sensor 35 and $O_2$ sensor 36 via the A/D converter 3*j* and input-output port 3*g*. The CPU 3*a* outputs signals for operating the ignitor 21 via the input-output port 3*g* and drive circuit 3*m*. Furthermore, the CPU 3*a* outputs signals for operating a particular injector 25 as designated, via a input-output port 3*g*, a pre-settable down counter 3*n*, a flip-flop circuit 3*p*, and a drive circuit 3*r*. The CPU 3*a* also calculates, as described later, a fuel injection amount, and presets a value of the amount to the down counter 3*n* while simultaneously setting the flip-flop circuit 3*p*, whereby the drive circuit 3 opens the designated injector 25 and commences a fuel injection. Upon the completion of a count down of a clock pulse corresponding to the preset value, the down counter 3*n* outputs a high level signal from a carry out terminal thereof, causing the flip-flop circuit 3*p* to be reset so that the drive circuit 3*r* de-energizes the injector 25 and terminates the fuel injection. Thus, a fuel amount which corresponds to Tau is introduced into the engine 2. Furthermore, a warning lamp 50 is connected to the input-output port 3*g*. The electronic control device 3 is supplied by a battery 41 via an ignition key switch 40. The back-up RAM 3*d* is supplied by the battery via not shown lines, so that the content of the memory is not erased regardless of the position of the ignition switch 40.

Figures 3, 3A:
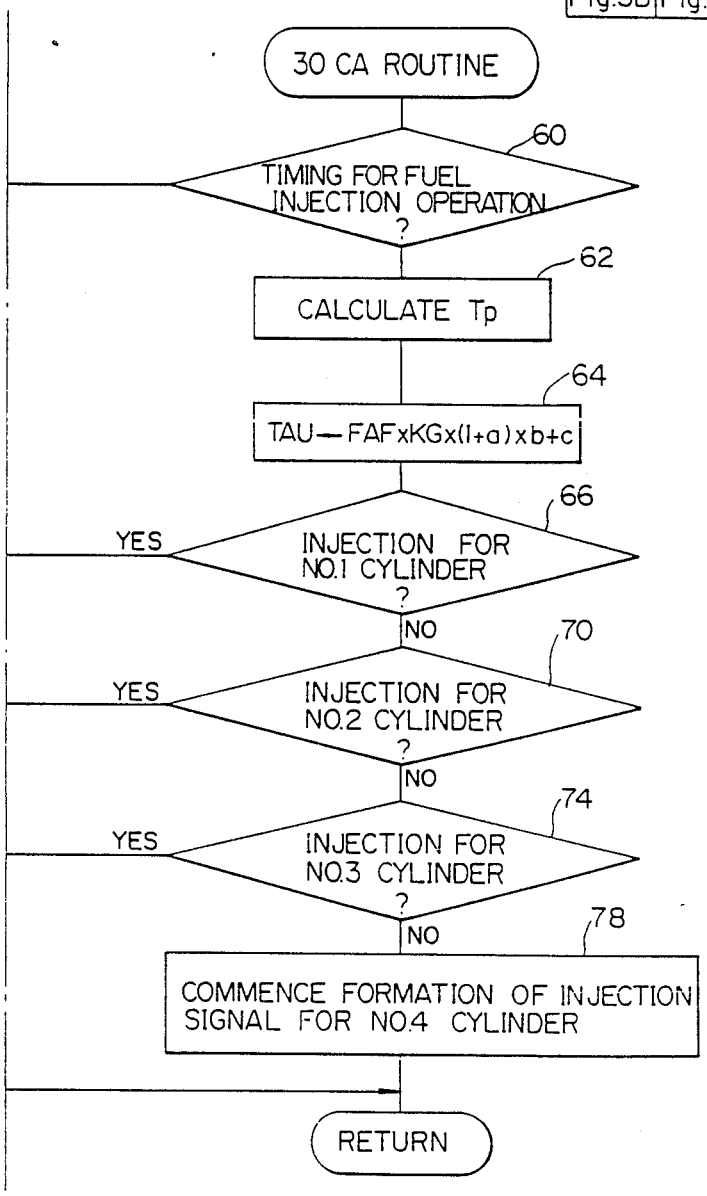
FIGS. 3, 3*a*, 3*b*, 4, 5, 5*a*, 5*b*, 6 and 7 are flowcharts illustrating the operation of the control circuit of the first embodiment shown in FIG. 1.
Figure 3B:
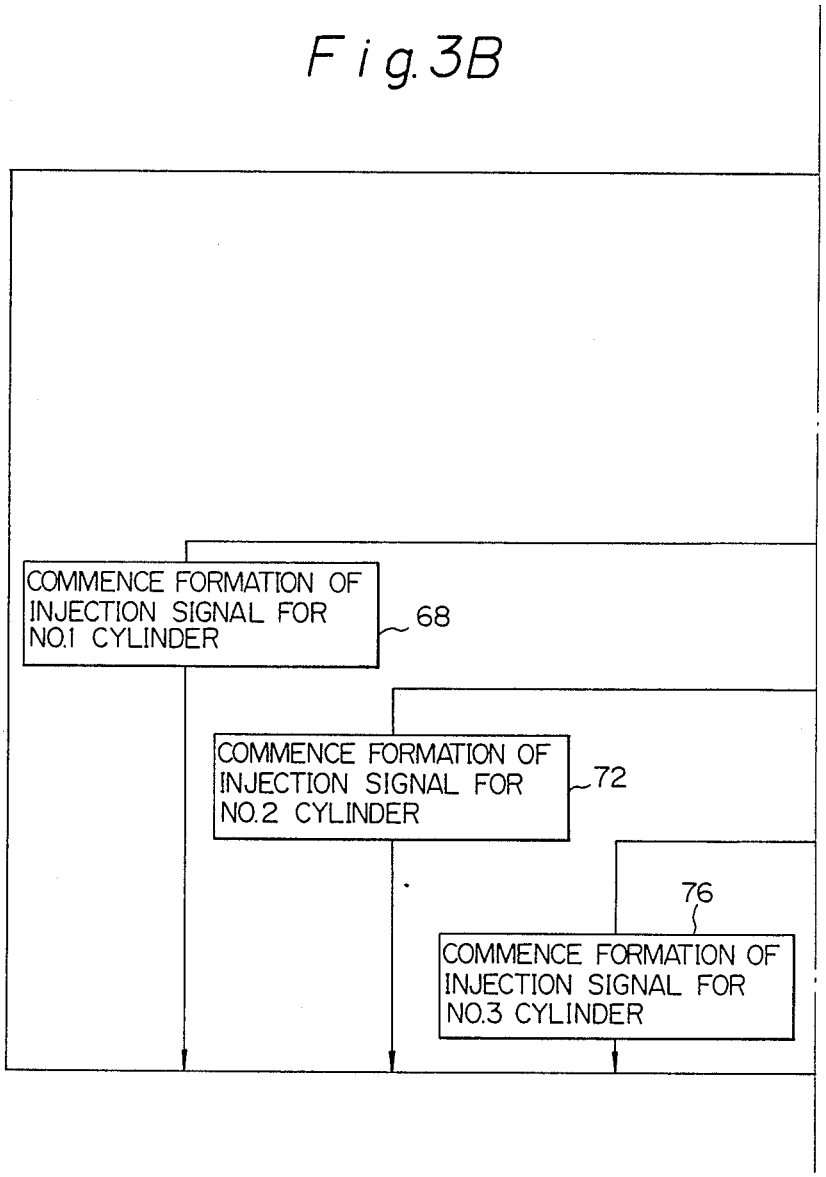

Now the operation of the electric control device 3 will be described with reference to the flow charts. FIG. 3 shows a crank angle interruption routine commenced upon the arrival of each pulse signal output by the second crank angle sensor 39 at every 30 degrees crank angle. At step 60, it is determined if this timing is for a calculation of a fuel injection amount. This timing occurs at every 180 degrees of crank angle if the engine is a four cylinder type, and can be detected by a number of 30 degree crank pulses after the detection of a reference 720 degrees pulse signal from the first crank angle sensor 38. When it is determined that this 30 degree timing is for a calculation of the injection amount, the routine goes to step 62, where a basic fuel injection amount Tp is calculated from the ratio Ga/Ne of an intake air amount GA to the engine speed Ne, based on a map. Next at step 64, a final fuel injection amount Tau is calculated by $$Tau = FAF \times KG \times (1+a) \times b + c,$$

where FAF is a feedback correction factor, as described later, KG is a learning correction factor, and a, b, and c are various correction amounts or factors for obtaining corrections of the fuel injection amount, which are not explained since they are not directly related to this invention. Then at step 66, it is determined if this timing is for an injection at the first cylinder. If the result is YES, the routine goes to step 68, where an injection signal is output to the injector 25 at the first cylinder to carry out a fuel injection of an amount Tau of fuel, as calculated. When the result at step 66 is NO, the routine goes to step 70, where it is determined if this timing is for an injection at the second cylinder. If the result is YES, the routine goes to step 72, where an injection signal is output to the injector 25 at the second cylinder to carry out a fuel injection of an amount Tau of fuel, as calculated. When the result at step 70 is NO, the routine goes to step 74, where it is determined if this timing is for an injection at the third cylinder. If the result is YES, the routine goes to step 76, where an injection signal is output to the injector 25 at the third cylinder to carry out a fuel injection of an amount Tau of fuel, as calculated. If the result at step 74 is NO, the routine goes to step 78, where an injection signal is output to the injector 25 at the fourth cylinder to carry out a fuel injection of an amount Tau of fuel, as calculated.

Figure 4:
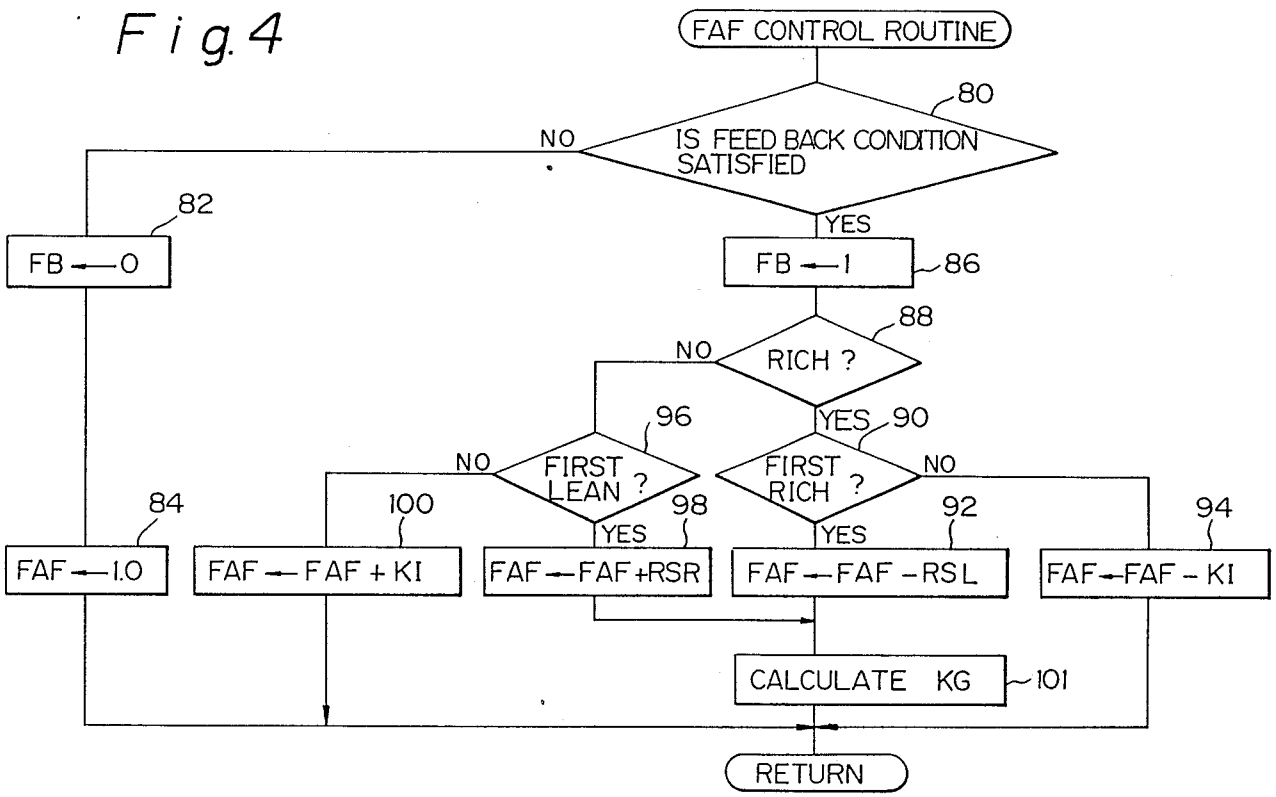

FIG. 4 shows a routine for calculating the feedback correction factor FAF used at step 64 in FIG. 3. This routine is obtained for a predetermined time such as 8 milliseconds. At step 80, it is determined if a feedback condition is satisfied. The feedback control is not, for example, obtained under particular conditions, such as a cold engine or the engine load is such that the throttle valve is wide open. When the engine is not under the feedback condition, the routine goes to step 82 where a feedback flag FB is reset, and to step 84, where a value of 1.0 is moved to the memory area for storing a value of the feedback correction factor FAF.

Figures 8A, 8B, 8C, 8D, 8E, 8F, 8G, 8H:
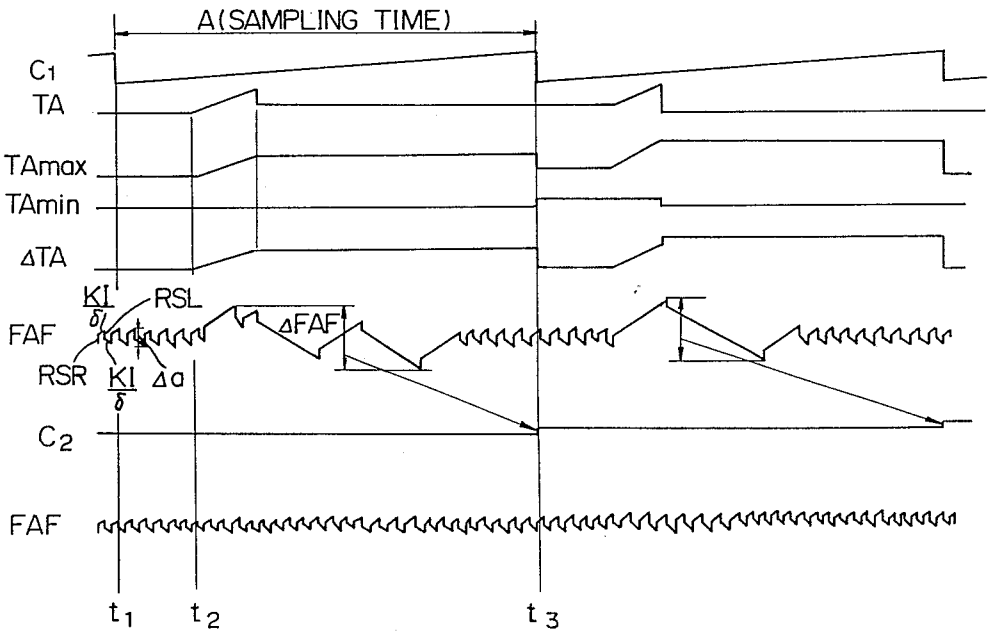
FIGS. 8(*a*) to 8(*h*) are timing charts illustrating the operation of the control circuit or the first embodiment shown in FIG. 1.

When the feedback condition is realized, the routine goes from step 80 to step 86, where the feedback flag FB is set, and to step 88 where it is determined if the air-fuel ratio sensed by the $O_2$ sensor 36 is rich with respect to a desired air-fuel ratio. If the result at the step 88 is YES, the routine goes to step 90, where it is determined if this is the first rich determination. When the result at step 90 is YES, the routine goes to step 92, where the value of FAF is decreased for RSL, which is a rich skip correction amount. When the result at step 90 is NO, the routine goes from step 90 to step 94, where the value of FAF is decreased for KI, which is an integral correction amount, so that the value of FAF is gradually decreased along the line having a slope KI divided by a time interval of the execution of this routine, KI/δ (see FIG. 8).

If the result at step 88 is NO, i.e., the air-fuel ratio is lean with respect to the target air-fuel ratio, the routine goes to step 96, Where it is determined if just is the first lean determination. When the result at step 96 is YES, the routine goes to step 98, where the value of FAF is increased for RSR, which is a lean skip correction amount. When the result at step 96 is NO, the routine goes from step 96 to step 100, where the value of FAF is increased for KI, so that the value of FAF is gradually increased along a line having a slope KI divided by a time interval of the execution of this routine, KI/δ (see FIG. 8).

Step 101, which enters into calculation when the skip correction (step 92 or 98) is carried out, generally designates a routine for calculating the learning correction factor KG. As well known to those skilled in the art, the value of KG is controlled in accordance with a mean value of FAF, so that the mean value of FAF, which is calculated as the mean values of consecutive FAF values just before the skip, is controlled to a value of 1.0.

Figures 5, 5A, 5B:
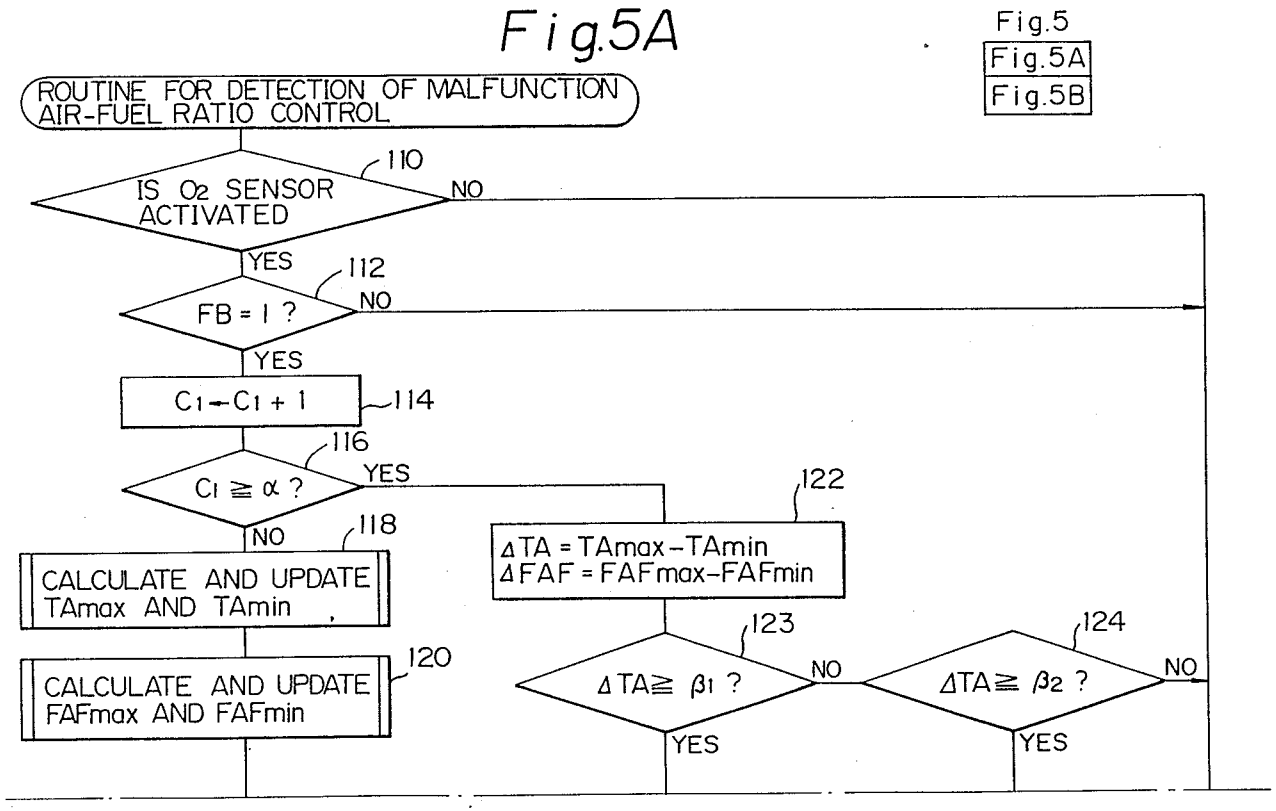
Figure 5B:
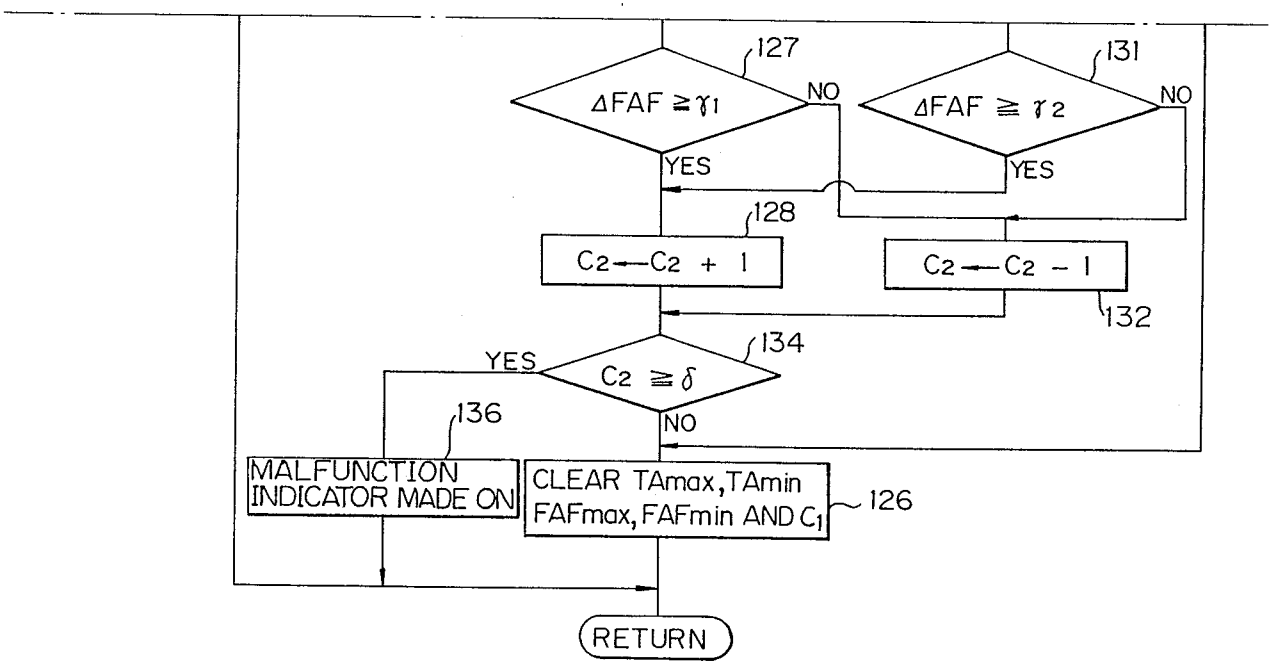
Figure 6:
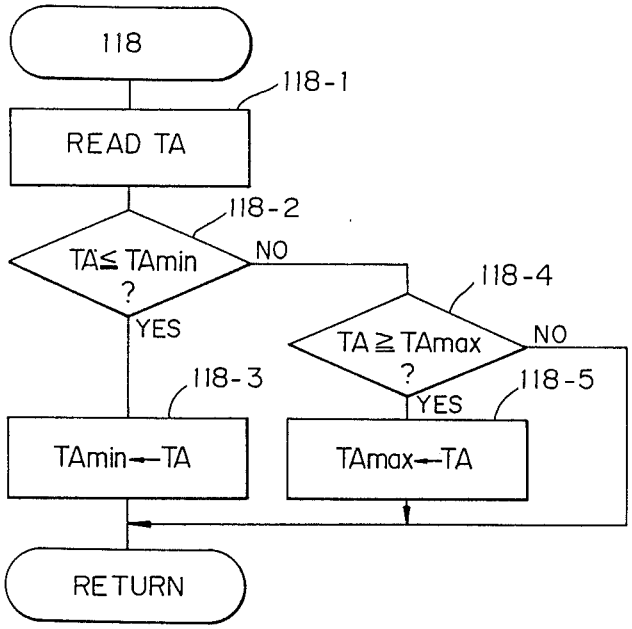

FIG. 5 is a routine for detecting a malfunction in an air-fuel ratio control system, which is executed at intervals of 8 milliseconds. This routine is used to detect a malfunction when the engine is under a condition in which the exhaust gas from the cylinders is unmixed, which condition is realized when the engine is accelerating. Upon the commencement of execution of this routine, at step 110, it is determined from information such as the temperature of the engine cooling water detected by the sensor 35, if the engine is under a condition in which the $O_2$ sensor 36 is operating normally. If the result at step 110 is YES, the routine goes to step 112, where it is determined if the feedback flag is set, i.e., the air-fuel ratio feed back is carried out. When the feedback control is carried out, the routine goes from step 112 to step 114, where a value of a counter $C_1$ is incremented by 1. At the following step 116, it is determined if the value of the counter $C_1$ is larger than a predetermined value $\alpha$, which is a time period A (FIG. 8(a)) for carrying out the routine of detecting a malfunction in the fuel injection system according to the present invention, and is determined so that it corresponds to a period required for obtaining a steady state of the change in a value of the feedback correction factor after an acceleration operation. When the result at step 116 is NO, the routine goes to step 118 and then to step 120. At step 118, the detail of which is shown in FIG. 6, the maximum and minimum values of a degree of opening of the throttle valve 14 during the above mentioned period, which are designated $TA_{max}$ and $TA_{min}$, respectively, are calculated and updated. At step 118-1, a value of a throttle opening degree TA sensed by the throttle position sensor 33 is read out, and at step 118-2, it is determined if the now read out value of the throttle degree TA is equal to or smaller than the throttle degree value stored in the memory area for storing the minimum value of the throttle opening degree $TA_{min}$. If the result at step 118-2 is YES, the routine goes to step 118-3, where the value of is replaced by the value TA. If the result at step 118-2 is NO, the routine goes to step 118-4, where it is determined if the value of the throttle degree TA just read out is larger than the throttle degree value stored in the memory area for storing the maximum value of the throttle opening degree $TA_{max}$. If the result at step 118-4 is YES, the routine goes to step 118-5, where the value $TA_{max}$ is replaced by the value TA.

Figure 7:
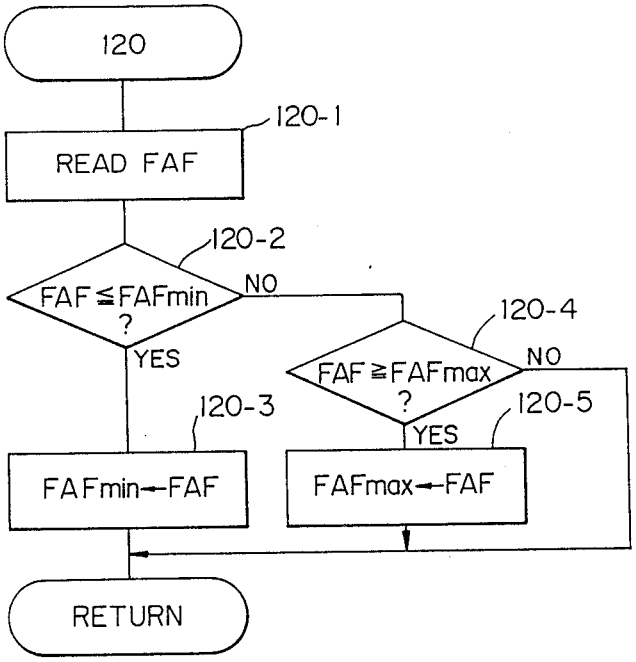

At step 120 in FIG. 5, the detail of which is shown in FIG. 7, the maximum and minimum values of the degree of the value of the feedback correction factor FAF during the above mentioned period, which are designated $FAF_{max}$ and $FAF_{min}$, respectively, are calculated and updated. At step 120-1, the present value of the feedback correction factor FAF is input, and at step 120-2, it is determined if the value of FAF is equal to or smaller than the value in the memory area for storing the minimum value of the feedback correction factor for storing $FAF_{min}$. If the result at step 120 is YES, the routine goes to step 112-3, where the minimum value of the feedback correction factor $FAF_{min}$ is replaced by FAF. If the result at step 120-2 is NO, the routine goes to step 120-4, where it is determined if the value of FAF is equal to or larger than the value in the memory area for storing the maximum value of the feedback correction factor for storing $FAF_{max}$. If the result at step 120-4 is YES, the routine goes to step 112-5, where the maximum value of the feedback correction factor $FAF_{max}$ is replaced by FAF.

In FIG. 5, when it is determined that the counter $C_1$ has reached the value $\alpha$ at step 116, this signifies that the predetermined one sampling period A for detecting a malfunction in the air-fuel ratio control system has lapsed. In this case, the routine goes to step 122, where, based on the maximum degree of throttle opening $TA_{max}$, a minimum degree of throttle opening $TA_{min}$, maximum feedback correction factor value $FAF_{max}$ and minimum feedback correction factor value $FAF_{min}$, a value of change in the degree of the throttle valve opening $\Delta TA$ and value of the amplitude of the feedback correction factor $\Delta FAF$ during the period A is calculated by $$\Delta TA = TA_{max} - TA_{min} \quad (1)$$

$$\Delta FAF = FAF_{max} \times FAF_{min} \quad (2)$$

The routine then goes to step 123, where it is determined if the value $\Delta TA$ is larger than a predetermined value $\beta_1$, i.e., an acceleration operation of a large change in the degree of opening of the throttle valve, such as a rapid acceleration, has occurred during the predetermined time period A. At step 124 it is determined if the value of $\Delta TA$ is larger than a predetermined value $\beta_2$, which is smaller than $\beta_1$ in step 123, i.e., an acceleration operation of a intermediate change in the degree of opening of the throttle valve, such as a mild acceleration, has occurred during the predetermined time period A. When the result at steps 123 and 124 is NO, i.e., when the engine has maintained a steady state condition of the value $\Delta TA$ lower than not only $\beta_1$ but also the predetermined value $\beta_2$, the routine goes to step 126, where $TA_{max}$, $TA_{min}$, $FAF_{max}$, $FAF_{min}$ and the counter $C_1$ are cleared.

When the value $\Delta TA$ is larger than the predetermined value $\beta_1$, i.e., a rapid transient state operation has occurred during the period A for detecting a malfunction in the fuel injection system, the routine goes from step 123 to step 127, where it is determined if the value of the amplitude of the feedback correction factor, $\Delta FAF$ is larger than a predetermined value $\tau_1$. When $\Delta FAF$ is equal to or larger than $\tau_1$, i.e., there was an impermissible deviation of the air-fuel ratio from the target value caused by a rapid engine transient state, the routine goes to step 128 where the value of a counter $C_2$ is incremented by 1. When $\Delta FAF$ is smaller than $\tau_1$, i.e., there was no impermissible deviation of the air-fuel ratio from the target value caused by the engine transient state, the routine goes to step 132 where the value of a counter $C_2$ is decremented by 1.

When the value $\Delta TA$ is larger than the predetermined value $\beta_2$ at step 124, i.e., a relatively mild transient state operation has occurred during the period A for detecting a malfunction in the fuel injection system, the routine goes from step 124 to step 131, where it is determined if the value of the amplitude of the feedback correction factor, $\Delta FAF$ is larger than a predetermined value $\tau_2$, which is smaller than $\tau_1$. When $\Delta FAF$ is equal to or larger than $\tau_2$, i.e., there was an impermissible deviation of the air-fuel ratio from the target value caused by the mild engine transient state, the routine goes to step 128 where the value of a counter $C_2$ is incremented by 1. When $\Delta FAF$ is smaller than $\tau_2$, i.e, there was no impermissible deviation of the air-fuel ratio from the target value caused by the engine transient state, the routine goes to step 132 where the value of a counter $C_2$ is decremented by 1.

As will be understood from the operation realized by steps 123 to 132, the value of the counter $C_2$ is changed in response to the occurrence of an impermissible value of the amplitude of the feedback correction factor. This means that the value of the counter $C_2$ corresponds to a frequency of the occurrence of an impermissible amplitude of the feedback correction factor caused by the transient state of the engine, which will not occur when the air-fuel ratio is operating normally. In steps 127 and 131, the threshold value of the amplitude ΔFAF during the rapid acceleration ($\Delta TA > \beta_1$), $\tau_1$ is larger than the threshold value of the amplitude ΔFAF during the mild acceleration ($\beta_1 > \Delta TA > \beta_2$), $\tau_2$, thereby obtaining a more precise warning control in accordance with a degree of acceleration. It is possible to simplify the routine in FIG. 5 by merely comparing ΔTA with a single threshold $\beta$, and then comparing ΔFAF with a single threshold $\tau$. In this latter case, steps 124 and 131 are omitted.

At step 134, it is determined if the value of the counter $C_2$ is larger than a predetermined value $\delta$. When the result at step 134 is YES, the routine goes to step 136, where a signal is output to the warning circuit 50 to turn a warning lamp 50 ON, and thus warn that a malfunction has occurred in the air-fuel ratio control. When the value of the counter $C_2$ is smaller than the predetermined value $\delta$, i.e., when there is no impermissible large amplitude of the feedback correction factor FAF or there is only a small frequency of the generation of the impermissible large amplitude of the feedback correction factor FAF, the routine goes to step 126, where $TA_{max}$, $TA_{min}$, $FAF_{max}$, $FAF_{min}$ and $C_1$ are cleared. This means that variations other than the counter $C_2$ are initialized when no malfunction is detected in order to repeat the above routine. It should be noted that the initializing routine is carried out when it is determined that the $O_2$ sensor is not operating properly due to an non-activated temperature at step 110, or when it is determined that the feedback control of the air fuel ratio was not carried out at step 112.

FIGS. 8(*a*) to 8(*h*) are schematic timing charts for illustrating the operation of the system of the first embodiment. At time $t_1$, the counter $C_1$ is cleared and a new sampling period A is commenced. At time $t_2$, an acceleration is commenced so that the value of TA begins to increase. The values of the maximum throttle opening $TA_{max}$, minimum throttle opening $TA_{min}$, and change in the throttle opening ΔTA are memorized as shown in FIGS. 8(*c*), 8(*d*) and 8(*e*), respectively. A change in value of the feedback correction factor FAF is shown in FIG. 8(*f*), where RSL is a lean skip correction, RSR is a rich skip correction, and KI is an integral correction. The amplitude of FAF is small, as shown by $\Delta_a$ in FIG. 8(*f*), when the engine is in a steady state, but the commencement of the acceleration causes the amplitude of FAF to be increased if a malfunction has occurred in the air-fuel ratio control system (The amplitude of FAF will be substantially unchanged upon acceleration, as shown in FIG. 8(*h*), if there is no malfunction in the air-fuel ratio control system.) The maximum value of the amplitude during the sampling period A is memorized, and the counter $C_2$, if larger than the threshold level, is incremented by 1 at the end ($t_3$) of the sampling period A, as shown in FIG. 8(*g*). This process is repeated for every sampling period.

As illustrated above, a detection of a malfunction in the air-fuel ratio control system is obtained when a large value of the amplitude in the feedback correction factor occurs continuously or frequently during a transient state of the engine. As a result, a detection of a malfunction caused not only by a change in the engine characteristic as a whole but also by a change in the engine characteristic in a particular cylinder, is possible as explained below.

(i) When a change in the characteristic of the air flow meter 31 and a change in the characteristic of a fuel injector 32 occur simultaneously, the air-fuel ratio control system controls the air-fuel ratio to maintain it in a predetermined range, by controlling the feedback correction factor FAF including a learning correction KG factor multiplied thereto during a steady state of the engine. In this case, if the change in the characteristic of the air flow meter 31 and the change in the characteristic of a fuel injector 32, such that the effects of these characteristic changes cancel each other out, occur simultaneously, the detection of a malfunction in the air-fuel ratio control system can not be effected from the value of FAF and FG, which are multiplied as in the prior art. Contrary to this, according to the present invention, the warning operation in FIG. 5 is carried out under the transient condition where the change in the characteristic of parts of the air-fuel control system, such as the air-flow meter, easily causes the air-fuel ratio representing value, FAF to be changed correspondingly, due to a delay in the learning operation of the air-fuel ratio. As a result, a malfunction caused by the respective characteristic, which affects the operation of the air-fuel ratio, can be easily detected.

Where the engine has a malfunction in only one cylinder, the warning system according to the present invention detects the malfunction when the engine is in the transient state at which the exhaust gas from the respective cylinders can reach the $O_2$ sensor 36 without being substantially mixed. Therefore, a detection of a malfunction in the air-fuel ratio control system occurring in only one cylinder can be detected.

Furthermore, the present invention is not restricted to the particular embodiment as illustrated. Namely, to detect a transient state for carrying out the warning control according to the present invention, a degree of change in engine speed can be detected instead of a detection of the degree of change in the degree of opening of the throttle valve. Furthermore, the warning operation according to the present invention can be commenced by detecting a condition in which the throttle valve is wide open, or by determining a high flow speed of a large amount of intake air.

Figures 9, 9A, 9B:
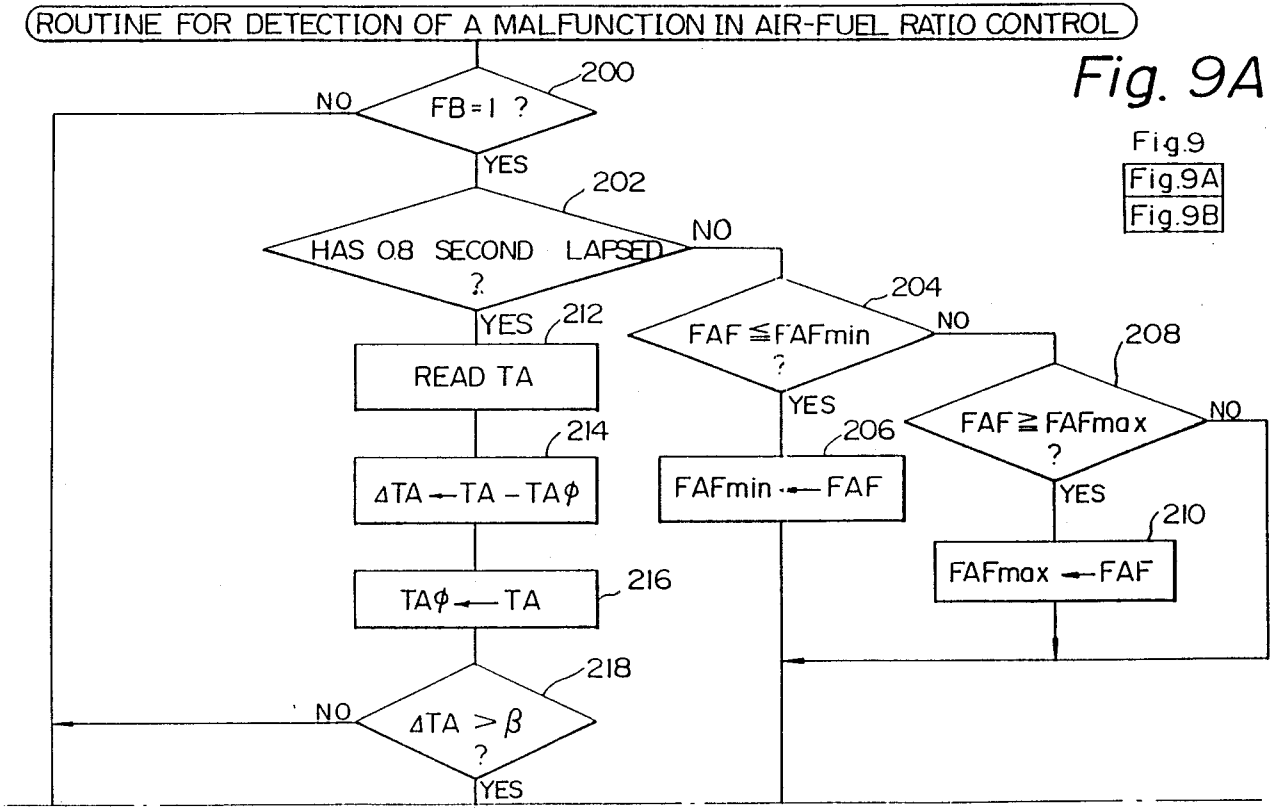
FIG. 9, 9*a* and 9*b* are a flowchart of the warning routine, as a modification of the first embodiment.
Figure 9B:
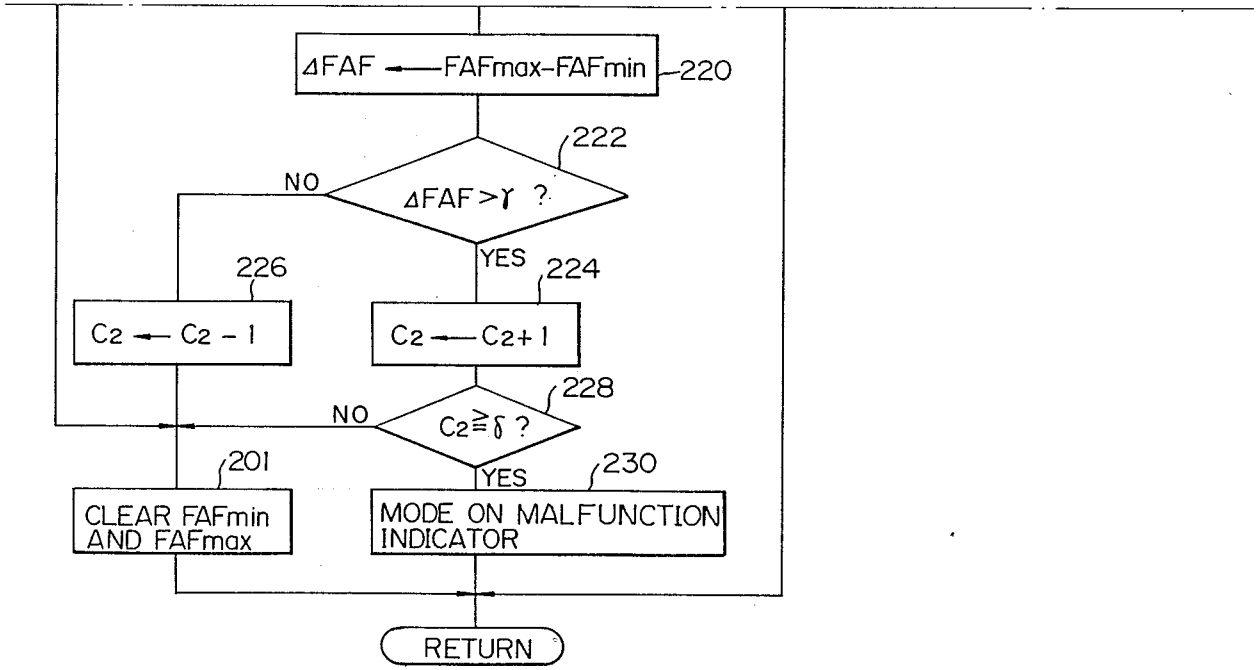

FIG. 9 shows a flowchart of a modification of the warning control routine of the first embodiment. This routine is different from FIG. 5 in that a sampling of the data of an occurrence of a rough air-fuel ratio caused by an acceleration and the sampling of the data of the occurrence of an acceleration, are carried out simultaneously during the acceleration. It should be noted that, in the first embodiment, the sampling of the data of the occurrence of a roughly controlled air fuel ratio in step 118, and the sampling of the data of the occurrence of the acceleration operation, are carried out without a direct connection to the acceleration operation. Thus it is easily understood that the detection of the rough air-fuel ratio in this second embodiment, caused by the acceleration, should be carried out within a short period synchronous with the acceleration. When &.he feedback control is carried out at step 200, the routine goes to step 202, where it is determined whether a predetermined sampling period, such as 0.8 second, which is short enough to detect the change in the degree of opening of the throttle value during the acceleration and long enough to detect the displacement of the value FAF caused by the accelerator, has lapsed. When the predetermined period of 0.8 second has not lapsed, the routine goes to steps 204 to 210, to update the maximum and minimum values of the air-fuel ratio correction factor, $FAF_{max}$ and $FAF_{min}$. This routine realized by steps 204 to 210 is exactly the same as the routine realized by steps 120-2 to 120-5 in FIG. 7 in the first embodiment, as already explained in detail. As a result, at steps 204 to 210, the maximum and minimum correction factor $FAF_{max}$ and $FAF_{min}$ during the period of 0.8 seconds are updated, and the $FAF_{max}$ and $FAF_{min}$ are cleared at step 201 during a non-feedback condition.

After the sampling period of 0.8 second has lapsed (yes at step 202), the routine goes to steps 212 and 214, where a throttle opening degree change ΔTA during the period of 0.8 second is calculated as the value of a throttle opening degree TA now detected by the sensor 33 and subtracted by the degree sensed at the preceding timing, TAϕ. At step 216, TA is moved to TAϕ to calculate ΔTA for the following sampling period. The routine then goes to step 218, where it is determined whether ΔTA is larger than a threshold value $\beta$, to determine whether the engine is under acceleration. When the engine is under acceleration, the routine goes to step 220, where the value of an amplitude in the feed back correction factor, ΔFAF is calculated as the maximum correction factor $FAF_{max}$ subtracted by the minimum correction factor F , caused by this acceleration. Then, the routine goes to steps 222 to 226, which are similar to steps 123, 127, 128, and 132 or steps 124, 131, 128 and 131 in FIG. 5 of the first embodiment. As a result, the value of the counter $C_2$ is incremented (step 224) if a rough air-fuel ratio as a large value of amplitude of ΔFAF has occurred, and is decremented (step 226) if such a rough air-fuel ratio has not occurred. The routine then goes to steps 228 and 230, which are exactly the same as the steps 134 and 136 in FIG. 5, where the warning process is carried out if the value of the counter $C_2$ is larger than the threshold value δ.

This modification realized by FIG. 9 detects the amplitude ΔFAF simultaneously with the detection of the acceleration, and thus the sampling period is shortened.

Figures 10A, 10B, 10C:
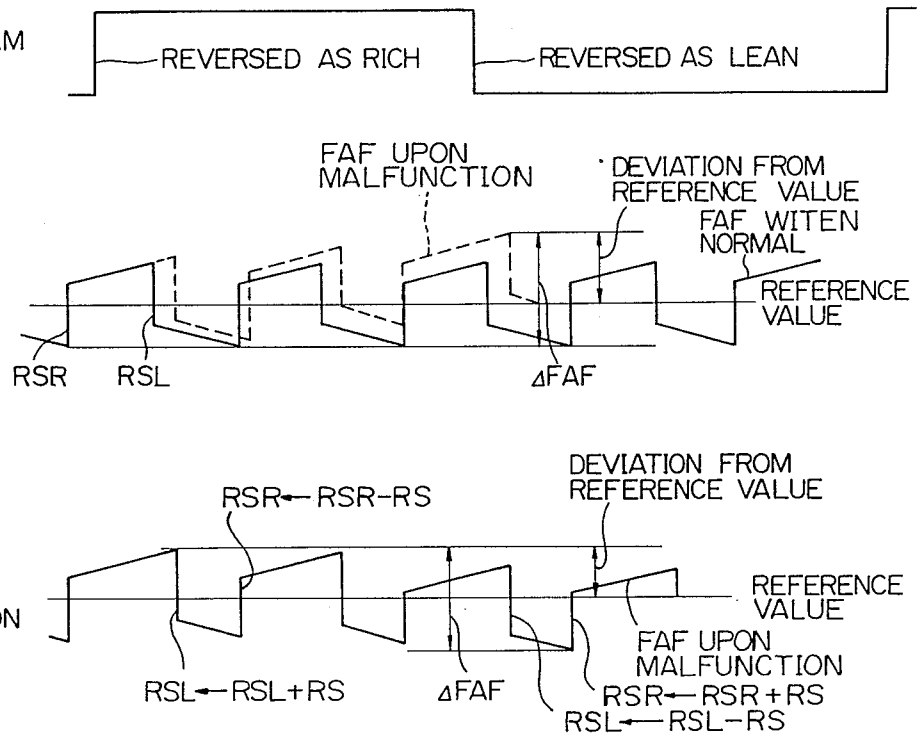
FIGS. 10(*a*) to 10(*c*) illustrate the control of the feedback correction factor in the double air-fuel ratio sensor system.

A second embodiment of the present invention concerns the application of the warning system according to the present invention to a double air-fuel ratio sensor system, wherein, in addition to the first air-fuel ratio sensor 36 arranged upstream of the catalytic converter 19, a second air-fuel ratio sensor 37 is arranged downstream of the catalytic converter 19 as shown by a dotted line in FIG. 1, and thereby the air-fuel ratio control by the first sensor 36 is corrected by the second sensor 37. In this system, the feedback correction factor FAF generated on the basis of signals from the first sensor 36 is automatically corrected in accordance with signals from the second sensor 37. This system also operates to correct malfunctions occurring in the air-fuel ratio control system, since the value of FAF is maintained in a desired range by the signal from the second sensor 37. In other words, if only the technique disclosed in the first embodiment of the present invention is applied to the double air-fuel ratio sensor system, it is possible for a malfunction in the air-fuel ratio control to be timely and correctly detected. FIG. 10(*a*), (*b*) and (*c*) respectively are schematic views of the operations of the downstream air-fuel ratio sensor 37, upstream air-fuel ratio sensor 36 when the downstream sensor 37 is not operated, and upstream air-fuel ratio sensor 36 when the downstream sensor 37 is operated. When the air-fuel control system operates normally, the change in the feedback correction factor FAF is schematically designated by the solid line in FIG. 10(*b*) where RSL and RSR are lean and rich skip corrections, respectively. When a malfunction occurs in the air-fuel ratio control system, the change in the value FAF is shown by the dotted line in FIG. 10(*b*), i.e., the amplitude ΔFAF is increased with respect to the value of the amplitude during the normal state. However, the operation of the downstream sensor 37 is such that the large amplitude ΔFAF as shown by a dotted line in FIG. 10(*b*) is corrected to the normal amplitude, as in FIG. 10(*c*). The second embodiment allows the warning system according to the present invention to be applied to the double air-fuel ratio sensor system, to attain a proper operation of the system.

It should be noted that the second embodiment differs from the first embodiment, from the viewpoint of hardware, only in that the second air-fuel ratio sensor 37 is further provided. The remaining construction is substantially the same as that of the first embodiment, and therefore, a detailed explanation thereof is omitted.

Figure 11:
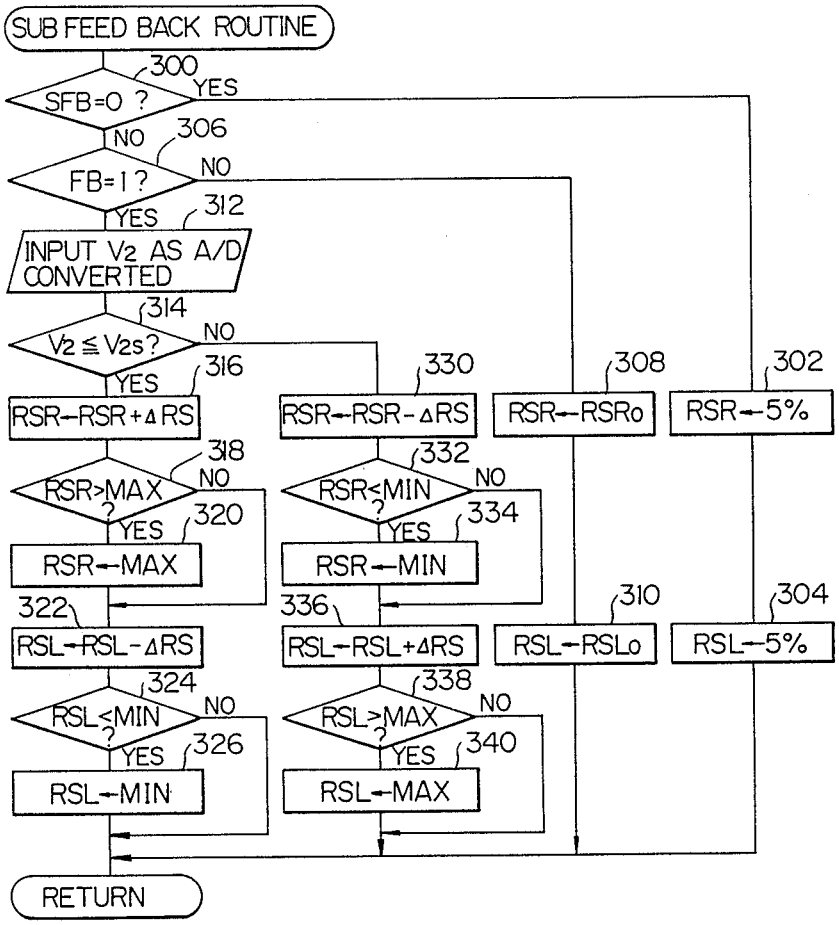
FIGS. 11, 12, 12*a* and 12*b* are flowcharts illustrating the operation of the control circuit in the second embodiment directed to a double air-fuel ratio sensor system.

The operation of the control circuit 3 in the second embodiment of the present invention will be now described with reference to the flowcharts. The control circuit 3 carries out a fuel injection routine which is substantially the same as that shown by the flowchart of FIG. 3 of the first embodiment. The control circuit 3 also carries out a FAF control routine, referred to as a main feedback routine, which is substantially the same as that shown by the flowchart in FIG. 4. Therefore, these routines are omitted from the drawing, for simplicity. Note, nevertheless reference will be made to FIG. 4 in the following explanation of the system of the second embodiment. FIG. 11 is a sub-feedback routine carried out at a time interval of e.g., 500 milliseconds to control the values of a rich skip amount RSR and lean skip amount RSL in steps 92 and 98, respectively, in FIG. 4. At step 300, it is determined if a flag SFB is 0, i.e., the engine is in a condition wherein the sub-feedback operation is stopped. This flag is controlled by the execution of the warning control routine in FIG. 12, as fully described later. When SBF=0, the routine goes to step 302 where the rich skip correction amount RSR is fixed to a predetermined value, such as 5% of the FAF. Then, the routine goes to a step 304, where the lean skip correction amount RSL is fixed &.o a predetermined value, such as 5% of the FAF.

When SFB=1, i.e., a process for stopping the sub-feedback operation is not effected, the routine goes from step 300 to step 306, where it is determined if the feedback flag FB=1, i.e., that the engine is under the feedback condition. The control of this flag FB is carried out at step 80 in the FAF control routine in FIG. 4. When the engine is under the non-feedback condition, the routine goes to step 308, where the value of rich skip correction amount RSR is fixed to the value $RSR_0$ obtained at the latest skip operation, and then to step 310, where the value of a lean skip correction amount RSL is fixed to the value $RSL_0$ obtained at the latest skip operation. This means that the values of the skip amounts RSR and RSL remain unchanged, to stop the sub-feedback control operation when the air-fuel ratio feedback control condition is not satisfied.

When the sub-feedback procedure is not stopped, (SFB=1) and the engine is under the feedback condition (FB=1), the routine goes from step 306 to step 312 where the signal V2 from the downstream air-fuel ratio sensor 37 is taken and analogue to digital converted. At the following step 314, it is determined if the air-fuel ratio V2 detected by the sensor 37 is smaller than a predetermined value V2s, i.e., the air-fuel ratio is on the lean side. When the air-fuel ratio detected by the downstream sensor 37 is on the lean side, the routine goes to step 316, where the value of the rich skip correction RSR is incremented by ΔRS. At step 318, it is determined if the value of the rich skip correction RSR is larger than the predetermined maximum guard value MAX. When RSR>MAX, the routine goes to step 320, where the value of MAX is moved to RSR, and at step 323, the value of the lean skip correction RSL is decremented by ΔRS. At step 324, it is determined if the value of the lean skip correction RSL is smaller than the predetermined minimum guard value MIN. When RSR<MIN, the routine goes to step 326, where the value of MIN is moved to RSL.

When it is determined that the air-fuel ratio V2 detected by the sensor 37 is larger than a predetermined value V2s, i.e., the air-fuel ratio is on the rich side, the routine goes to step 330, where the value of the rich skip correction RSR is decremented by ΔRS. At step 332, it is determined if the value of the rich skip correction RSR is smaller than the predetermined minimum guard value MIN. When RSR<MIN, the routine goes to step 334, where the value of MIN is moved to RSR. At step 336, the value of the lean skip correction RSL is incremented by ΔRS, and at step 338, it is determined if the value of the lean skip correction RSL is larger than the predetermined maximum guard value MAX. When RSR >MAX, the routine goes to step 340, where the value of MAX is moved to RSL.

By this routine in FIG. 10, the values of the rich skip correction RSR and lean skip correction RSL are maintained between the maximum guard value MAX and minimum guard value MIN by the air-fuel ratio detected by the second sensor 37 arranged downstream of the catalytic converter 19.

Figures 12, 12A, 12B:
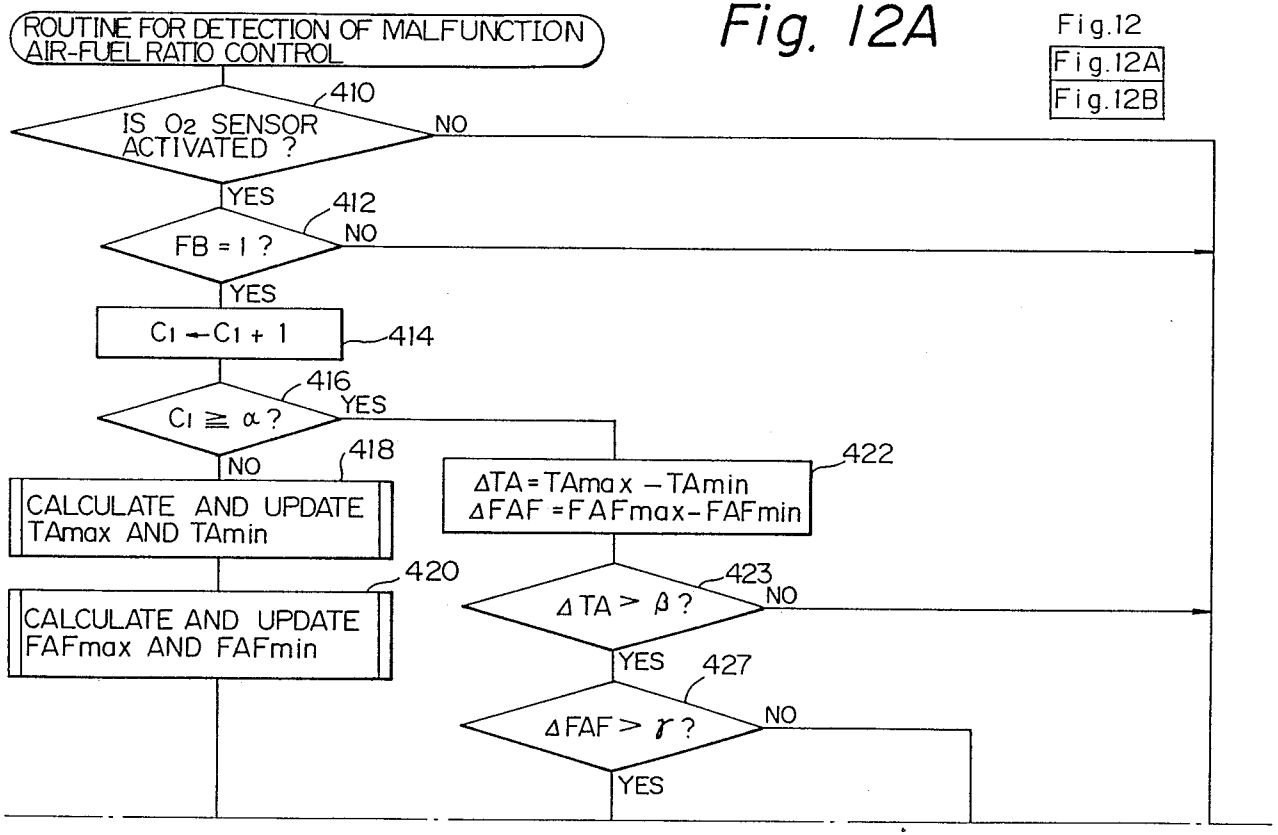
Figure 12B:
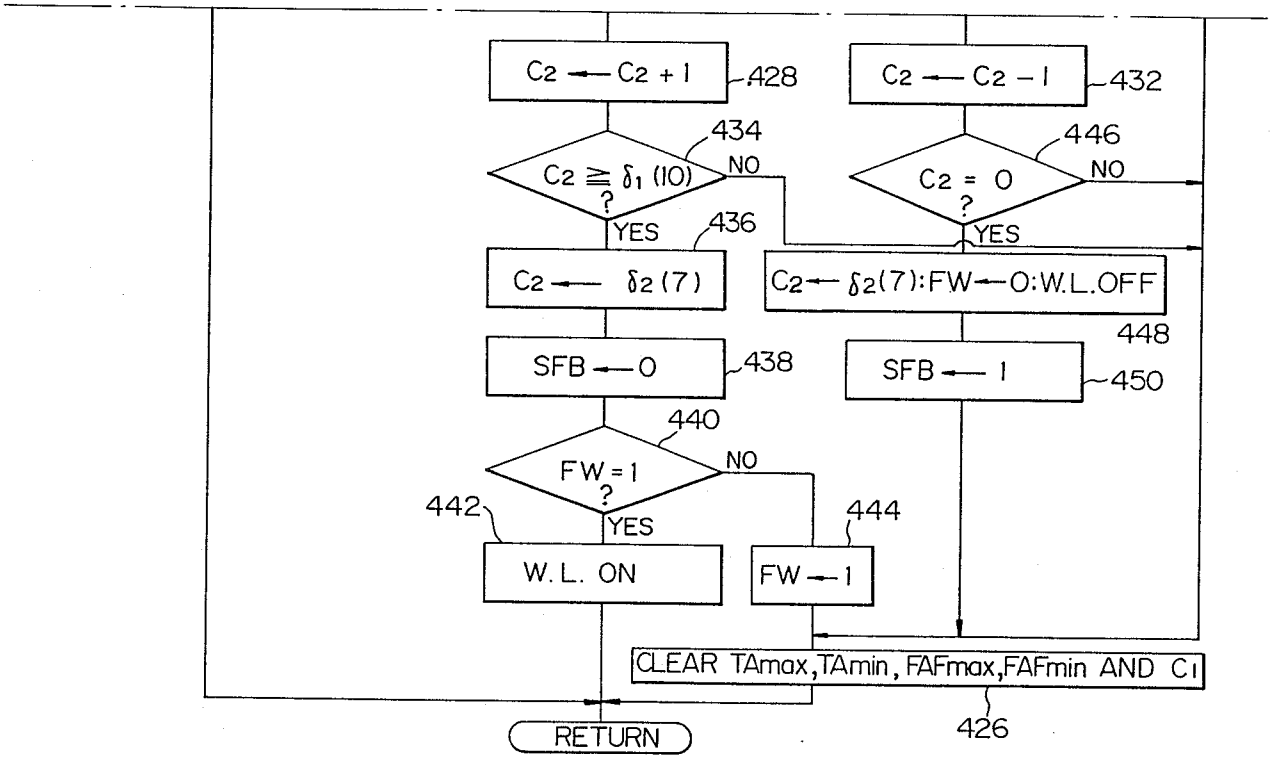

FIG. 12 is a warning control routine according to this embodiment related to the double air-fuel ratio sensor system. The routine for detecting the amplitude of the feedback correction factor, ΔFAF is the same as that of the first embodiment shown in FIG. 5. The maximum value of feedback correction factor, $FAF_{max}$ and the minimum value of the feedback correction factor, $FAF_{min}$ during a sampling period of, e.g., 20 seconds, determined by the counter, and the threshold value $\alpha$, are detected by the execution of the routine 418 and 420, which are exactly the same as shown by FIGS. 6 and 7 for the first embodiment. After the sampling period has elapsed (YES result at step 416), the maximum change of the throttle opening ΔTA and the feedback correction factor amplitude ΔFAF are calculated (step 422). Then, when acceleration occurs during the sampling period (YES result at step 423) a routine for control of a counter $C_2$ (step 428 or 432) in accordance with the value of the amplitude ΔFAF of the feedback correction factor with respect to the threshold value $\tau$ (step 427) is carried out, so that the value of the counter $C_2$ corresponds to the frequency of the impermissible movement of feedback correction factor caused by the acceleration, i.e., degree of indication of a malfunction in the air-fuel ratio control system. These steps 423 to 432 are exactly the same as steps 122 to 132 in FIG. 5.

When the value of the counter $C_2$ is incremented at step 428, due to the impermissible amplitude in the amplitude of the feedback correction factor caused by an acceleration during the sampling period, the routine goes to step 434, where it is determined whether the value of the counter $C_2$ is equal to or larger than a predetermined value $\delta_1$ such as 10. When the value of the counter has reached the value $\delta_1$, the routine goes to step 436, where the value of the counter $C_2$ is initialized to an initial value $\delta_2$, such as 7. At step 438, the sub-feedback flag SFB is cleared and the sub-feedback control is stopped by the execution of the routine executed by steps 300, 302 and 304 in FIG. 11. At step 440, it is determined if a preliminary warning flag FW is set. When the flag FW is not set (0), the routine goes to step 444, where the flag FW is set. When it is determined that the flag FW is set at step 440, the routine goes to step 442 to carry out the warning operation, such as making a warning lamp 50 ON. In other words, two consecutive results of the determination that an impermissible value of the amplitude ΔFAF of the feedback correction factor exists permit the warning operation to proceed to warn the operator that a malfunction has occurred in the air-fuel ratio control system.

When the value of the counter $C_2$ is decremented at step 432 because the permissible amplitude of the feedback correction factor occurred simultaneously with the acceleration, the routine goes to step 446, where is determined whether the value of the counter $C_2$ has decreased to zero. When the value of the counter has not yet decreased to zero, the routine goes to step 426 to clear the variables. When the value of the counter has reached zero, the routine goes to step 448 where the counter $C_2$ is initialized to $\delta_2$(7), the preliminary flag FW is cleared, and the warning lamp is made OFF. Then the routine goes to step 450, where the sub-feedback flag SFB is set so that the sub-feedback routine below step 312 in FIG. 11 is permitted to proceed to control the rich and lean skip corrections RSR and RSL in accordance with a signal from the second air-fuel ratio sensor downstream of the catalytic converter. Note, the initial counter value of 7 not 0 at step 436 or 448 is obtained to ensure that the number to be counted up to detect a malfunction (10−7=3) is smaller than the number to be counted down to detect that a malfunction has not occurred (7−0=7), so that a positive return to the normal operation is obtained.

Figures 13A, 13B, 13C, 13D, 13E:
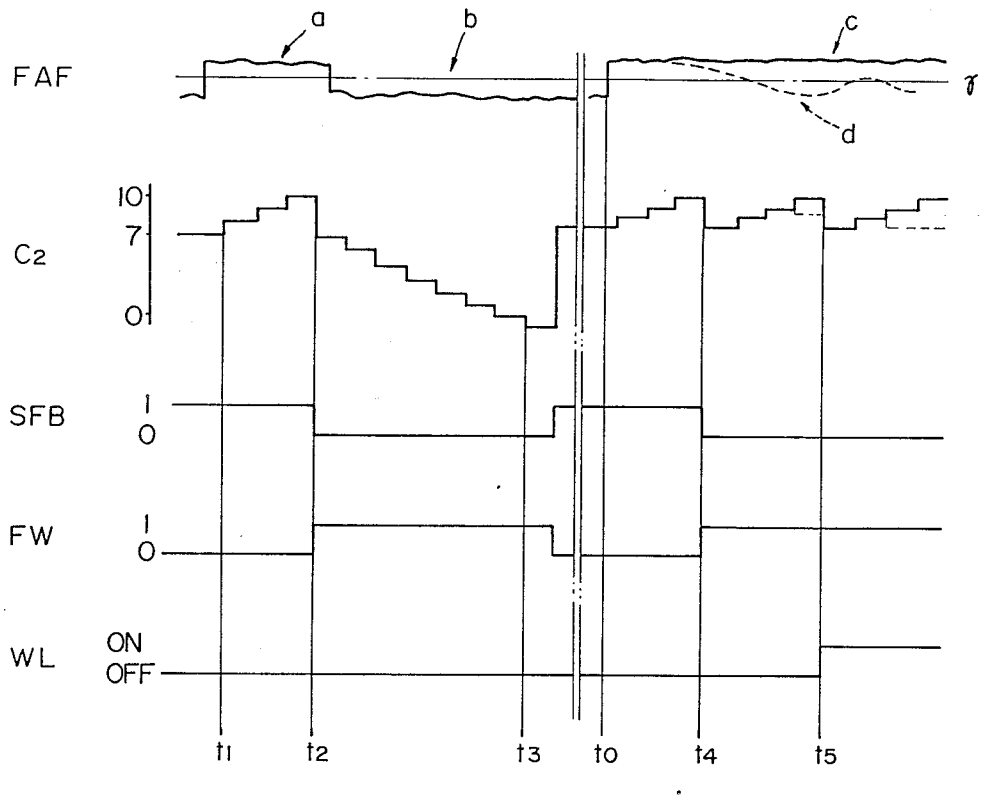
FIGS. 13(*a*) to 13(*e*) are timing charts illustrating the operation of the control circuit in the second embodiment. DESCRIPTION OF THE PREFERRED EMBODIMENTS In FIG. 1, 2 denotes a fuel injection type internal combustion engine having, for example, four cylinders, and 3 denotes an electronic control device for controlling the air-fuel ratio of a combustible mixture in the internal combustion engine 2.

FIGS. 13(*a*) to (*e*) are timing charts schematically illustrating the operation of the second embodiment. The value of the counter $C_2$ is, from the value of 7 at timing $t_1$, incremented by 1 for each sampling period which provides a value ΔFAF larger than the threshold value $\tau$ caused by the acceleration. When the value of the counter has reached 10 at time $t_2$, the counter is cleared to 7, the sub-feedback flag SFB is cleared to stop the sub-feedback operation, and the preliminary warning flag FW is set. Note, the warning lamp is not made ON at this first stage of warning process. If the first stage detection of a malfunction is temporary, as shown by line a, the amplitude will soon drop below the threshold line b (value $\tau$), so that the value of the counter $C_2$ is decreased to zero at timing $t_3$, and the counter $C_2$ is initialized to 7, the sub-feedback flag SFB is set to restart the sub-feedback, and the preliminary warning flag FW is cleared. The warning lamp is, of course, maintained OFF. Contrary to this, if the first stage detection of a malfunction at timing $t_4$ is not temporary, as shown by line c, the amplitude ΔFAF continues to be larger than the threshold line b, so that the value of the counter $C_2$ is again increased above 7, one by one, as the impermissible value of the amplitude ΔFAF larger than the threshold value $\tau$ is caused by an acceleration during the sampling period, and reaches the value 10 at timing $t_5$, causing the warning lamp to be made ON. It should be noted that, since the sub-feedback is stopped upon the first stage detection of a malfunction at timing $t_4$, the control of the FAF by the sub-feedback system to decrease the amplitude ΔFAF is prevented. As a result, a quick detection of the malfunction can be obtained. If the sub-feed back is maintained after the first stage detection of a malfunction ($t_4$), the sub-feedback system based on a signal from the second A/F sensor 37 can suppress the amplitude ΔFAF, as shown by the dotted line d, as time elapses, which would make a quick detection of a malfunction difficult. It should be noted that the sub-feedback routine in FIG. 11 takes place very slowly in comparison with the feedback routine in FIG. 4, i.e., the time interval for execution of the feedback routine in FIG. 4 is 8 ms, but the time interval for execution of the sub-feedback routine in FIG. 11 is 500 ms. This means that the value can be decreased only slowly by the sub-feedback operation from the timing $t_0$ at which the impermissible value of ΔFAF occurred, and thus detection of the first stage impermissible amplitude of ΔFAF at time $t_4$ is possible, regardless of the fact that the sub-feedback operation is carried out by that time.

It should be noted that, in this second embodiment directed to the double air-fuel ratio sensor system, the stoppage of the sub-feedback control operation is carried out when an impermissible amplitude ΔFAF occurs frequently. Instead, however, the sub-feedback operation can be stopped when the value of the amplitude ΔFAF is even once larger than a threshold value, and thereafter, the possibility of the correction of feedback correction factor FAF can be completely eliminated. This permits a malfunction in the air-fuel ratio control system to be detected even if the malfunction related to the air-fuel ratio is small.

It also should be noted that the correction of the main feedback by the sub-feedback is carried out by control of the skip amounts RSR and RSL in FIG. 11. However, in place of or in addition thereto, a system for changing the reply delay time in the feedback correction factor FAF when reversed can be employed. In this case, a construction will be provided for returning the delay time to an initial value during a stoppage of the sub-feedback system.

Although embodiments of the present invention are described with reference to the attached drawings, obviously many modifications and changes can be made by those skilled in this art without departing from the scope and spirit of the present invention.

We claim:

1. An internal combustion engine comprising:

an engine body having a plurality of cylinders;

an intake system having a throttle valve for controlling an amount of air introduced into respective cylinders in the engine body;

an exhaust system having upstream portions separately connected to respective cylinders of the engine body for a removal of resultant exhaust gas therefrom, and a common downstream portion;

means for supplying an amount of fuel into the intake system for providing a combustible mixture;

a first determining means, for determining a target value of the air-fuel ratio matching the operation conditions;

a calculating means for calculating an amount of fuel to be supplied to the engine by the fuel supply means to obtain the target air-fuel ratio;

air-fuel ratio sensor means arranged in the exhaust system at said common downstream portion for detecting an air-fuel ratio of the combustible mixture;

correction means, responding to a difference between the target air-fuel ratio obtained by the first determining means and the air-fuel ratio detected by the sensor means, for obtaining a correction value indicating a correction to be applied to the amount of fuel calculated by said calculating means, the corrected amount of fuel being supplied by the fuel supply means;

second determining means for determining a predetermined sampling period;

detecting means for detecting, for each sampling period, a condition of the engine in which the exhaust gas from the cylinders can reach the air-fuel ratio sensor means without being substantially mixed, and;

third determining means responding to a change in the correction value during that period, caused by the engine when in the non-mixing condition, for determining that a malfunction related to the air-fuel ratio control has occurred in the engine.

2. An internal combustion engine according to claim 1, further comprising means for giving a warning upon a determination of a malfunction.

3. An internal combustion engine according to claim 1, wherein said detecting means comprises means for detecting a degree of requirement of an output of engine, means for calculating a change in the degree of the output requirement during the sampling period, and means for a signal that a non-mixing condition has occurred when the change in the degree of the engine requirement is larger than a predetermined value.

4. An internal combustion engine according to claim 1, wherein the sampling period occurs simultaneously with an occurrence of a change in the degree of the output requirement.

5. An internal combustion engine according to claim 3, wherein said change is the difference between the maximum and minimum values of the engine output requirement during the sampling period.

6. An internal combustion engine according to claim 3, wherein said output requirement of the engine is a degree of opening of the throttle valve.

7. An internal combustion engine according to claim 1, wherein said third determining means comprise means for calculating an amplitude of the correction value of an air-fuel ratio caused by the non-mixing condition of the engine, and means for obtaining said determination based on a likelihood of a change in the amplitude of the air-fuel ratio correction value.

8. An internal combustion engine according to claim 7, wherein the amplitude is a difference between the minimum and maximum values of correction values during each sampling period.

9. An internal combustion engine according to claim 7, wherein said means for obtaining the determination comprise a counter which is incremented when the amplitude is larger than a predetermined value and is decremented when the amplitude is lower than the predetermined value, and means for issuing a warning signal when the value of the counter has exceeded a predetermined threshold value.

10. An internal combustion engine according to claim 9, wherein the predetermined threshold value of the amplitude is determined so as to vary in accordance with a degree of the non-mixing condition.

11. An internal combustion engine comprising:

an engine body having a plurality of cylinders;

an intake system having a throttle valve for controlling the amount of air introduced into the respective cylinders in the engine body;

an exhaust system having upstream portions separately connected to the respective cylinders of the engine body for a removal of resultant exhaust gas therefrom, and a common downstream portion;

means for supplying an amount of fuel into the intake system for providing a combustible mixture;

a catalytic converter arranged in the exhaust system;

a first determining means, for determining a target value of the air-fuel ratio matching the operating conditions;

a calculating means for calculating an amount of fuel to be supplied to the engine by the fuel supply means to obtain the target air-fuel ratio;

first air-fuel ratio sensor means arranged in the common downstream portion of the exhaust system located upstream of the catalytic converter for detecting an air-fuel ratio of the combustible mixture;

first correcting means, responding to a difference between the target air-fuel ratio obtained by the first determining means and the air-fuel ratio detected by the first sensor means, for calculating a correction value indicating a correction to be applied to the amount of fuel calculated by the said calculating means, the corrected amount of fuel being supplied by the fuel supply means;

second air-fuel ratio sensor means arranged in the exhaust system at a position downstream of the catalytic converter;

second correction means responding to the air-fuel ratio sensed by the second air-fuel ratio sensor means, for correcting the correction value by the first correcting means;

second determining means for determining a predetermined sampling period;

detecting means for detecting, for each sampling period, a condition of the engine in which the exhaust gas from the cylinders can reach the first sensor means without being substantially mixed, and;

third determining means, responding to a change in the correction value caused by the engine when in the non-mixing condition, for determining that a malfunction related to air-fuel ratio control has occurred in the engine, and;

means for stopping the correction operation by the second correction means when a warning signal is output by the third determining means.

12. An internal combustion engine according to claim 11, further comprising means for giving a warning upon a determination of a malfunction.

13. An internal combustion engine according to claim 12, wherein said warning by the warning means is carried out upon a repeated detection of a malfunction after the stopping means has stopped the correction operation by the second correcting means.

14. An internal combustion engine according to claim 11, wherein said detecting means comprises means for detecting a degree of a requirement of the output of the engine, means for calculating a change in the degree of the output requirement during the sampling period, and means for issuing a signal that the non-mixing condition has occurred when the change in the degree of the engine requirement is larger than a predetermined value.

15. An internal combustion engine according to claim 14, wherein said change is the difference between the maximum and minimum values of the requirement during a sampling period.

16. An internal combustion engine according to claim 11, wherein said degree of engine output requirement is a degree of opening of the throttle valve.

17. An internal combustion engine according to claim 11, wherein said third determining means comprise means for calculating an amplitude of the correction value of an air-fuel ratio because the engine is under the non-mixing condition, and means for obtaining said determination from a likelihood of a change in the amplitude of the air-fuel ratio correction value.

18. An internal combustion engine according to claim 17, wherein the amplitude is a difference between the minimum and maximum values of the correction value during each sampling period.

19. An internal combustion engine according to claim 17, wherein said means for obtaining the determination comprise a counter which is incremented when the amplitude is larger than a predetermined value and is decremented when the amplitude is lower than the predetermined value, and means for issuing a warning signal when the value of the counter exceeds a predetermined threshold value.

20. An internal combustion engine according to claim 19, further comprising means for restarting the operation of the second correcting means when the counter is decreased to a predetermined value, and means for initializing the counter to an initial value.

21. An internal combustion engine according to claim 20, wherein the predetermined value for restarting the operation of the second correcting means is lower than the initial value of the counter.

* * * * *